US007510185B2

(12) United States Patent
Tsai

(10) Patent No.: US 7,510,185 B2
(45) Date of Patent: Mar. 31, 2009

(54) PUSHER OF A HOCKEY GAME TABLE

(76) Inventor: Jerry Tsai, No. 22, Lane 20, Ziachiang Street, Taichung (TW)

( * ) Notice: Subject to any disclaimer, the term of this patent is extended or adjusted under 35 U.S.C. 154(b) by 0 days.

(21) Appl. No.: 11/690,875

(22) Filed: Mar. 26, 2007

(65) Prior Publication Data

US 2008/0237980 A1 Oct. 2, 2008

(51) Int. Cl.
*A63F 7/07* (2006.01)

(52) U.S. Cl. ..... 273/108.5

(58) Field of Classification Search ..... 273/108, 273/108.1, 108.5, 126 R, 148 B; 463/38; D21/385; 345/161
See application file for complete search history.

(56) References Cited

U.S. PATENT DOCUMENTS 3,907,294 A * 9/1975 Breslow ..... 273/108.1
4,091,234 A * 5/1978 Bristow ..... 345/161
4,161,726 A * 7/1979 Burson et al. ..... 341/9
4,509,383 A * 4/1985 Yeh ..... 74/471 XY
4,748,441 A * 5/1988 Brzezinski ..... 345/161
5,532,476 A * 7/1996 Mikan ..... 250/221
5,643,087 A * 7/1997 Marcus et al. ..... 463/38
5,929,846 A * 7/1999 Rosenberg et al. ..... 345/161
6,624,806 B2 * 9/2003 Hsu ..... 345/161
2004/0145113 A1 * 7/2004 Giegerich ..... 273/108.1
2006/0017223 A1 * 1/2006 Chen ..... 273/108.5

* cited by examiner

*Primary Examiner*—Raleigh W. Chiu
(74) *Attorney, Agent, or Firm*—Ming Chow; Sinorica, LLC

(57) ABSTRACT

A pusher of a hockey game table includes a main body having an internal spherical space and a pushing knob having a spherical rotary member rotatably disposed in the spherical space of the main body. When holding the pushing knob and pushing the pusher, the pushing knob is angularly displaceable relative to the main body in the direction of the pushing force. Therefore, when pushing the pusher to play the hockey game, the player's wrist can be freely twisted to meet human body engineering.

18 Claims, 9 Drawing Sheets

PUSHER OF A HOCKEY GAME TABLE

BACKGROUND OF THE INVENTION

The present invention is related to a game device, and more particularly to a pusher of a hockey game table, which is designed with a structure in considerations of ergonomics and which can be easily hold and operated.

On a hockey game table, a player pushes a disc with a pusher to play the game.

A conventional pusher has a circular tray body and a boss fixed on the top face of the tray body. A player can hold the boss to move the pusher.

The boss is integrally connected with the tray body. When pushing the pusher, the player's wrist can hardly twist. Therefore, the player's wrist feels stiffness and is easy to be tired and hurt. The configuration of the conventional pusher fails to meet considerations of human body engineering so that the player can hardly operate the pusher.

SUMMARY OF THE INVENTION

It is therefore a primary object of the present invention to provide a pusher of a hockey game table, which has a structure in considerations of human body engineering and which can be easily hold and operated.

The present invention can be best understood through the following description and accompanying drawings wherein:

DETAILED DESCRIPTION OF THE PREFERRED EMBODIMENTS

Figure 1:
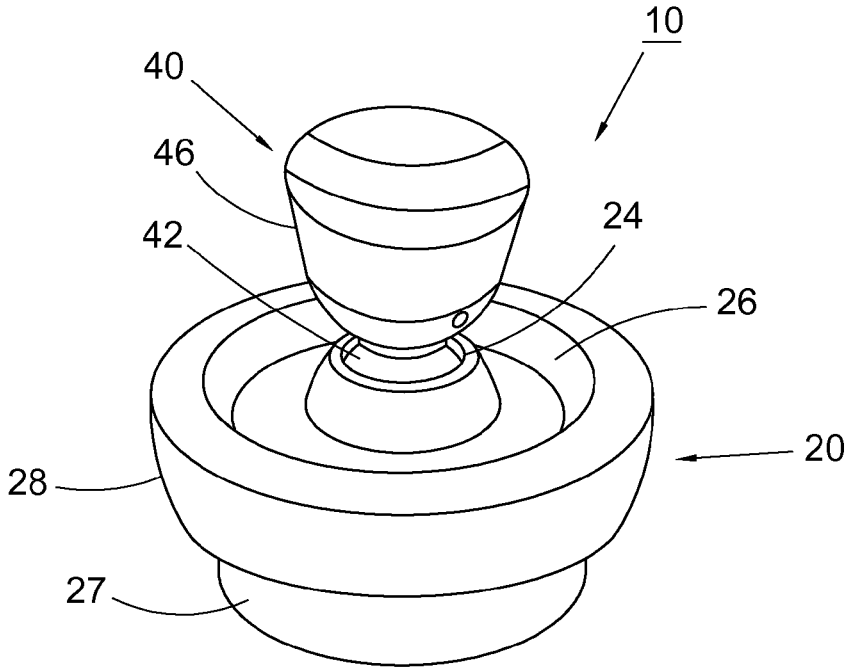
FIG. 1 is a perspective view of a preferred embodiment of the present invention.
Figure 2:
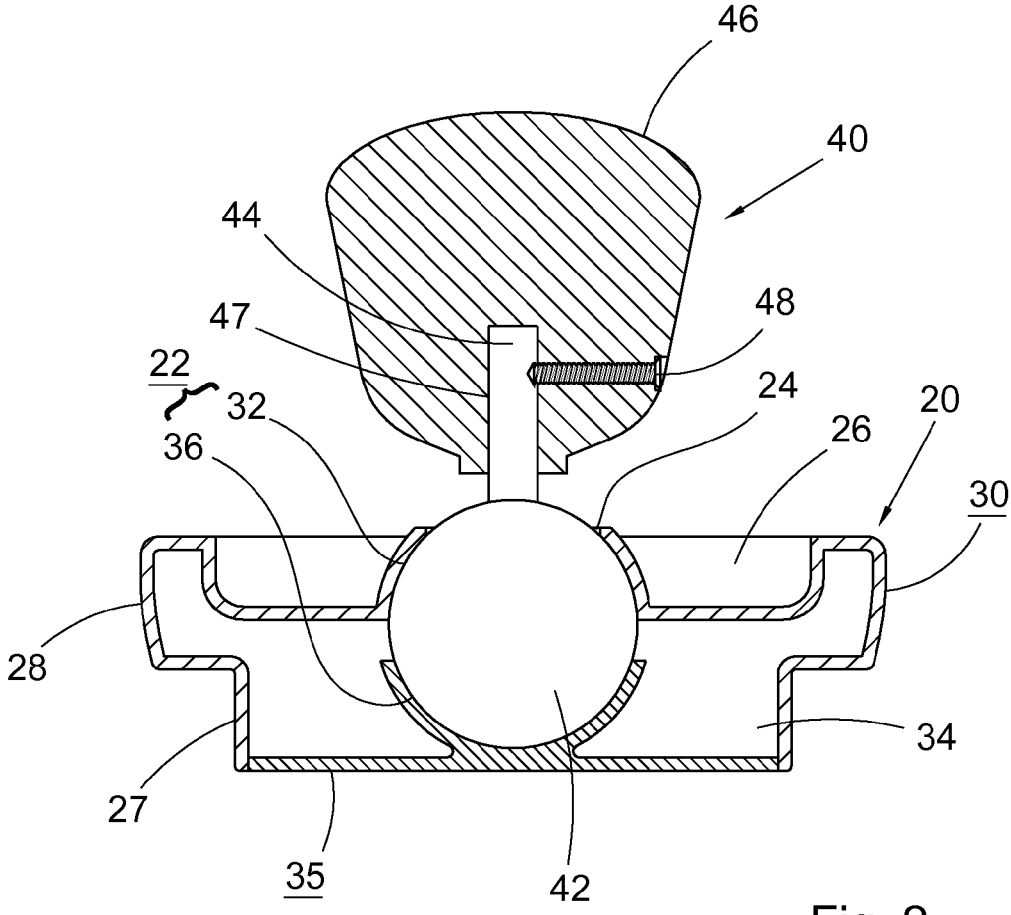
FIG. 2 is a sectional view of FIG. 1.

Please refer to FIGS. 1 and 2. According to a first embodiment, the pusher 10 of the present invention includes a main body 20 and a pushing knob 40. The main body 20 has an internal spherical space 22. A top face of the main body 20 is formed with an opening 24 communicating with the space 22. The pushing knob 40 has a bottom end mounted in the space 22, and the pushing knob 40 is positioned outside the main body 20 for a player to hold.

Figure 3:
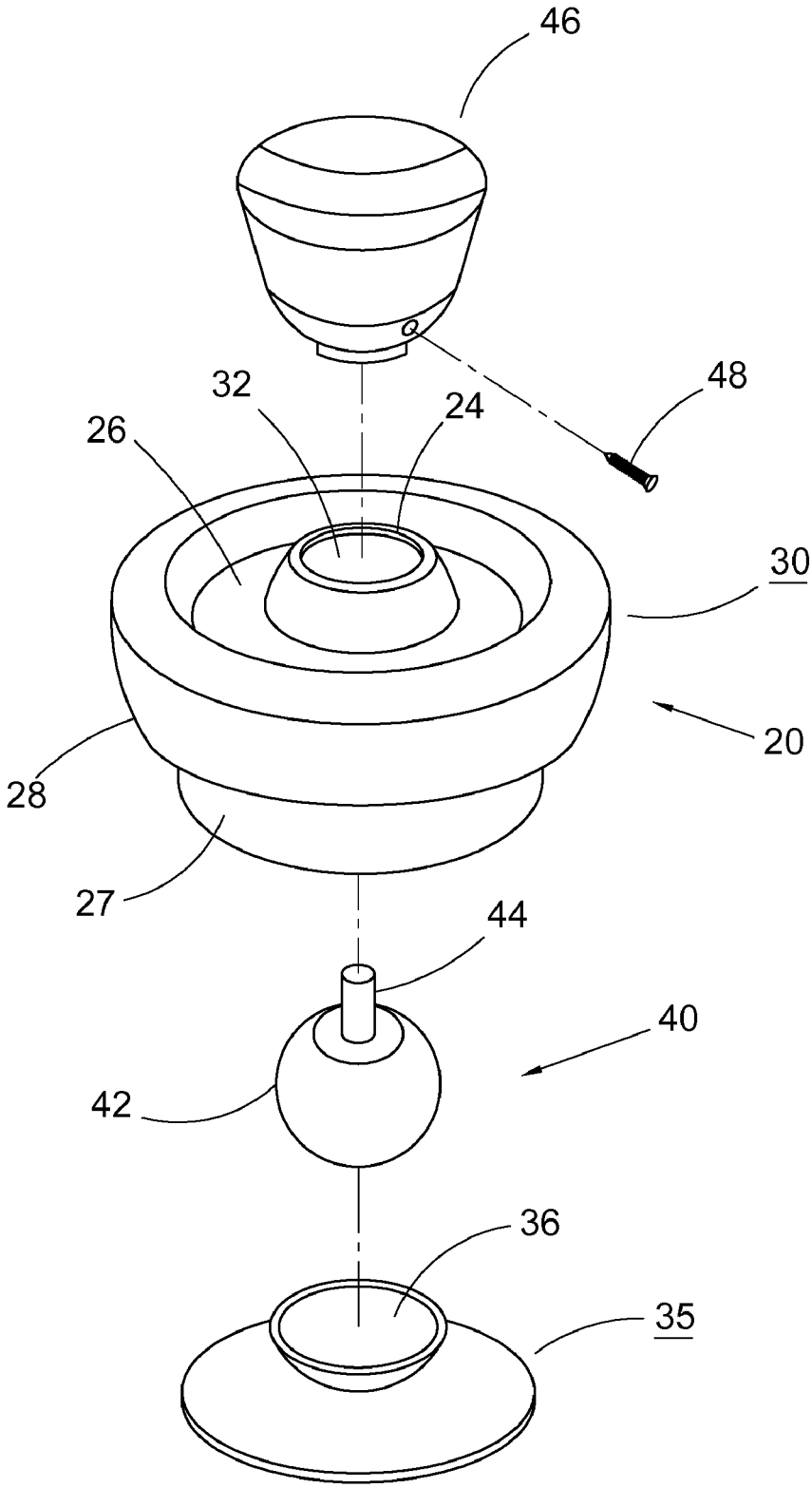
FIG. 3 is a perspective exploded view of FIG. 1.

Also referring to FIG. 3, the main body 20 is composed of an upper half body 30 and a lower half body 35. The upper and lower half bodies 30, 35 can be hollow or solid. The center of the interior of the upper half body 30 is formedwitha semispherical upper cavity 32. The upper cavity 32 has an opening facing downward, and the inside of the upper cavity 32 is upward tapered. The center of the interior of the lower half body 35 is formed with a semispherical lower cavity 36. The lower cavity 36 has an opening facing upward, and the inside of the lower cavity 36 is downward tapered. The bodies 30, 35 are connected with each other while the lower half body 35 is fitted in a bottom opening 34 of the upper half body 30 and fixedly combined with the upper half body 30. The upper and lower cavities 32, 36 are aligned with each other to form the spherical space 22. The opening 24 is formed on the top face of the upper half body 30 to communicate with the upper cavity 32.

Figure 5:
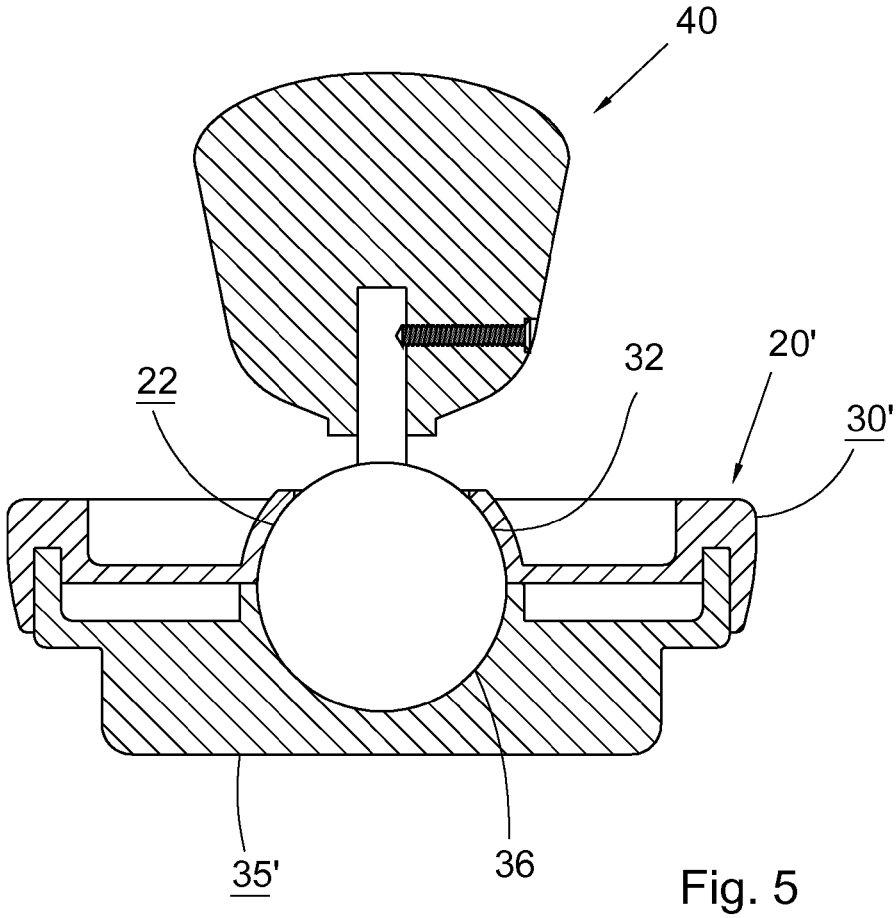
FIG. 5 is a sectional view of an embodiment of the present invention.

It should be noted that the upper and lower half bodies can be assembled in many manners. The assembling measure is not limited to this embodiment. For example, as shown in FIG. 5, the upper and lower half bodies 30' and 35' are solid which are fitted to each other.

The pushing knob 40 has a spherical rotary member 42 and a rod member 44. The rotary member 42 is rotatably disposed in the spherical space 22 of the main body 20. A bottom end of the rod member 44 is connected with the rotary member 42. A top end of the rod member 44 protrudes from the main body 20 through the opening 24 thereof. A knob member 46 is fixedly connected with the top end of the rod member 44 for a player to hold. The top surface of the knob member 46 is downward tapered. A bottom face of the knob member 46 is recessed to form a connecting hole 47 in which the top end of the rod member 44 is fitted. A screw member 48 is screwed into the knob member 46 to fixedly connect with the rod member 44.

In addition, the top face of the main body 20 is recessed to form an annular depression 26 centered at the opening 24. The outer circumference of the main body 20 is stepped to form a small diameter section 27 on a lower half and a large diameter section 28 on an upper half thereof.

Figure 4:
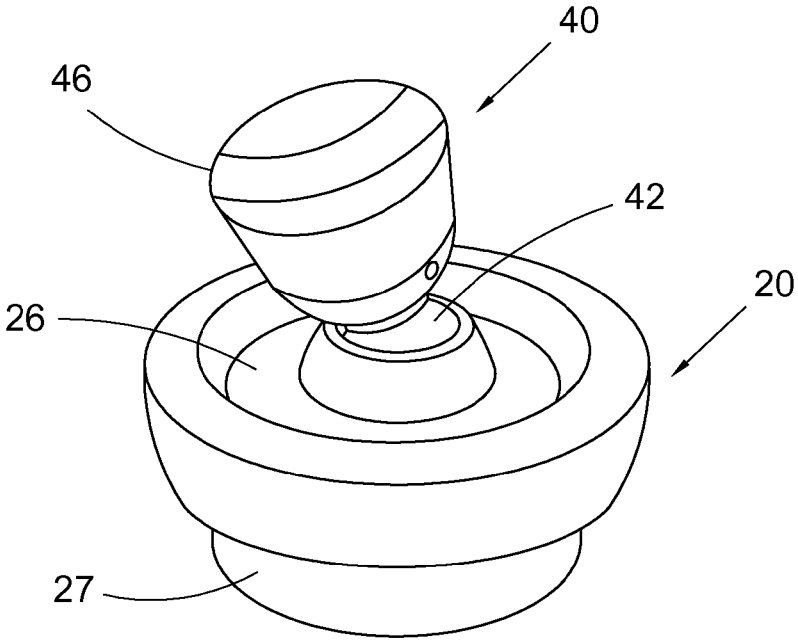
FIG. 4 is a perspective view of FIG. 1, showing the use of the pusher of the present invention.

When use, a player operates the knob member 46 back and forth to push the pusher 10 for driving a disc. The small diameter section 27 serves to contact with the disc. The player's fingertips are accommodated in the annular depression 26 of the top face of the main body 20. The rotary member 42 of the pushing knob 40 is rotatable within the space 22 of the main body 20 so that the pushing knob 40 is angularly displaceable relative to the main body 20. Therefore, when pushing the pusher 10, the pushing knob 40 can be angularly displaced in the direction of the pushing force. For example, as shown in FIG. 4, when pushing the pusher 10 leftward, the pushing knob 40 is leftward angularly displaced in the direction of the pushing force.

Figure 6:
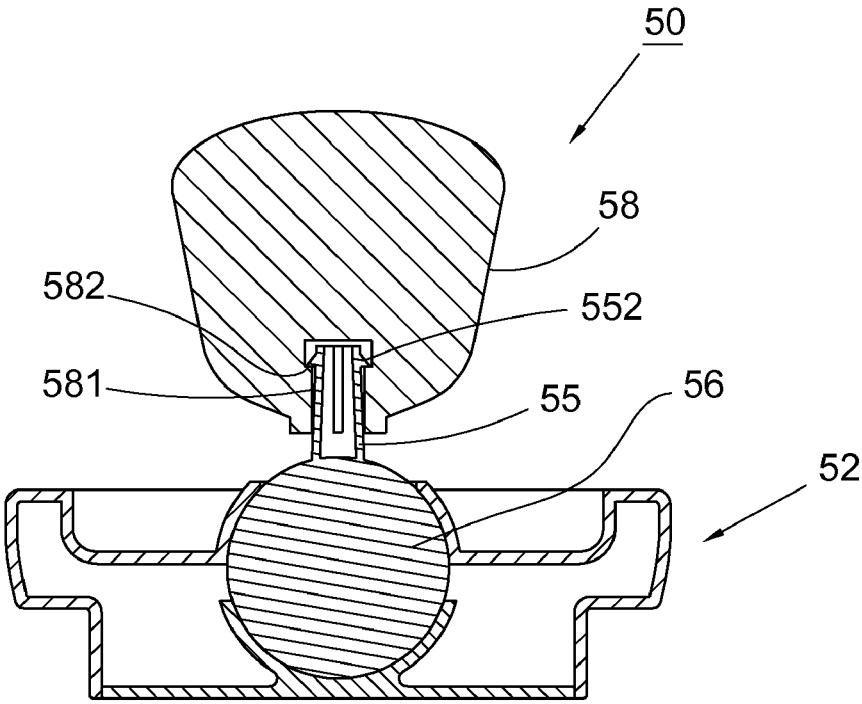
FIG. 6 is a sectional view of an embodiment of the present invention.
Figure 7:
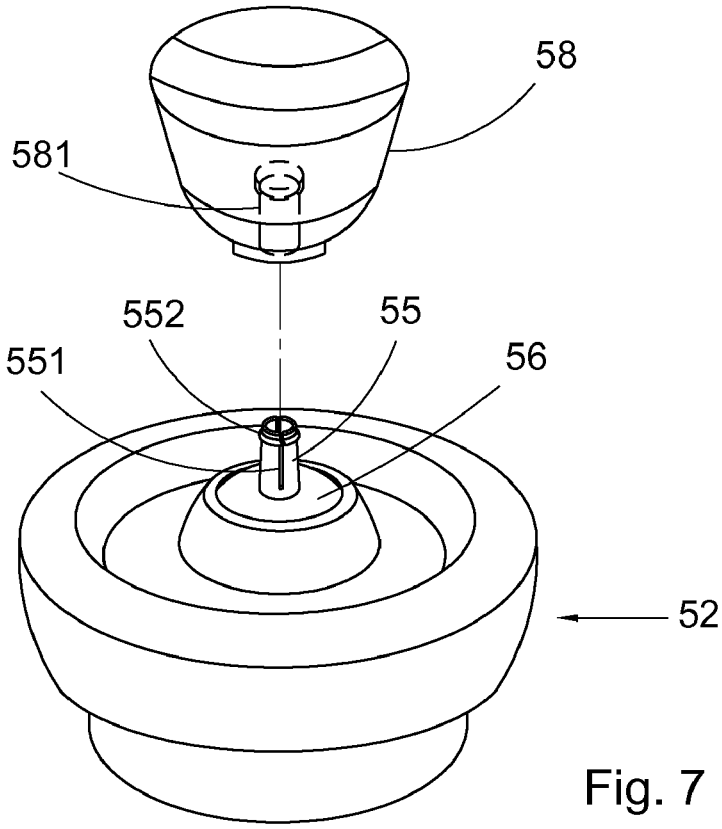
FIG. 7 is a perspective exploded view of FIG. 6.

FIGS. 6 and 7 show another embodiment of the pusher 50 of the present invention, in which the main body 52 can be any of the aforesaid structures and will not be further described hereinafter.

In this embodiment, the bottom end of the rod member 55 is fixedly connected with the rotary member 56. The top end of the rod member 55 is formed with a split 551 and is thus resilient. The top end of the rod member 55 is formed with a hook head 552 and is fitted into the connecting hole 581 of the knob member 58. The hook head 552 hooks a shoulder section 582 of the connecting hole to connect the rod member with the knob member.

Figure 8:
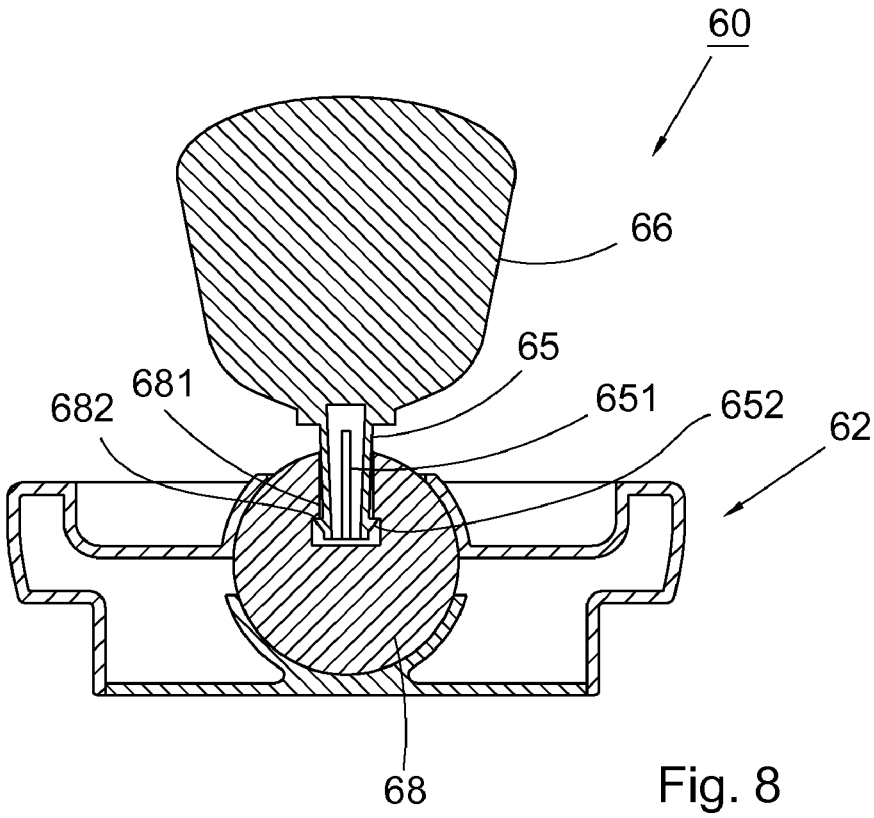
FIG. 8 is a sectional assembled view of an embodiment of the present invention.

FIG. 8 shows another embodiment of the pusher 60 of the present invention, in which the main body 62 has a structure that is identical to that of the first embodiment.

The top end of the rod member 65 is fixedly connected with the knob member 66. The bottom end of the rod member 65 is formed with a split 651 and is thus resilient. The bottom end of the rod member 65 is formed with a hook head 652 and is fitted into the connecting hole 681 of the rotary member 68. The hook head 652 hooks a shoulder section 682 of the connecting hole to connect the rod member with the rotary member.

Figure 9:
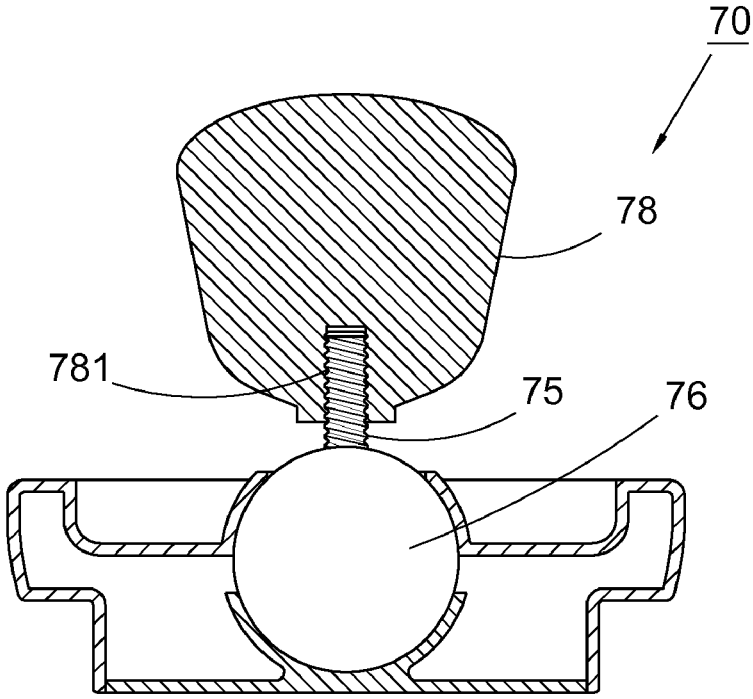
FIG. 9 is a sectional assembled view of an embodiment of the present invention.
Figure 10:
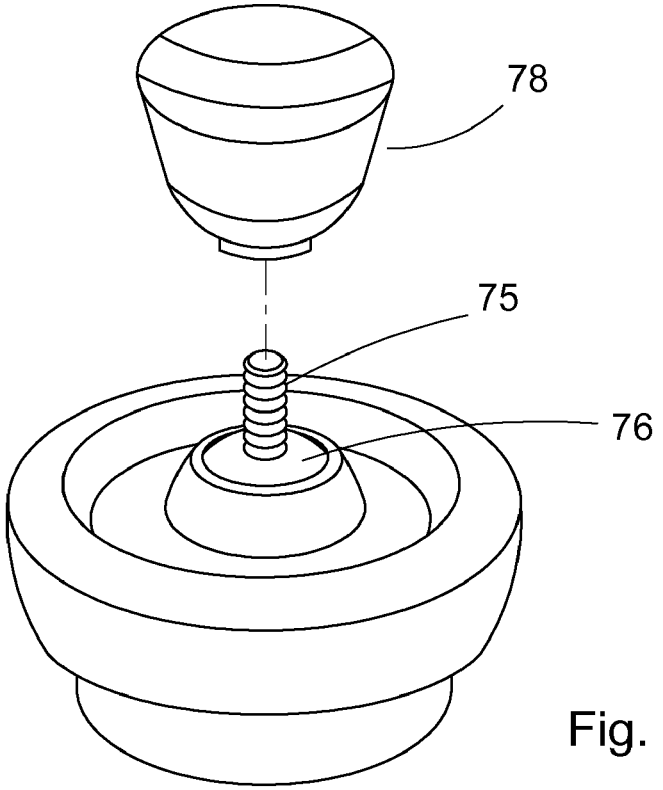
FIG. 10 is a partial perspective exploded view of FIG. 9.

FIGS. 9 and 10 show another embodiment of the pusher 70 of the present invention, in which the rod member 75 is a threaded rod. The bottom end of the threaded rod is fixedly connected with the rotary member 76. A thread hole 781 is formed on the bottom face of the knob member 78. The top end of the threaded rod 75 is screwed in the thread hole 781.

Figure 11:
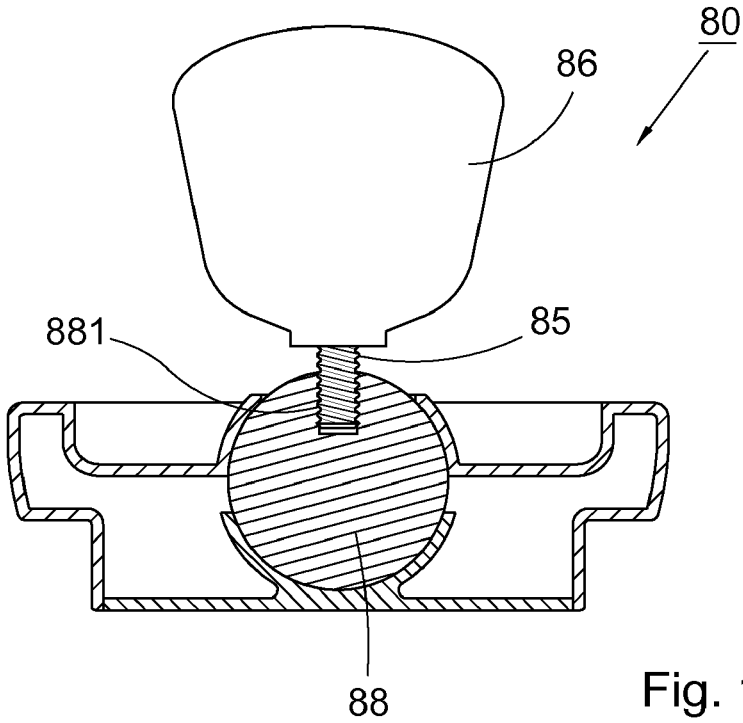
FIG. 11 is a sectional assembled view of an embodiment of the present invention.

FIG. 11 shows another embodiment of the pusher 80 of the present invention, in which the rod member 85 is also a threaded rod as the embodiment of FIG. 9. The difference is that the top end of the rod member 85 is fixedly connected with the knob member 86, while the bottom end of the rod member 85 is screwed in a thread hole 881 of the top face of the rotary member 88.

Figure 12:
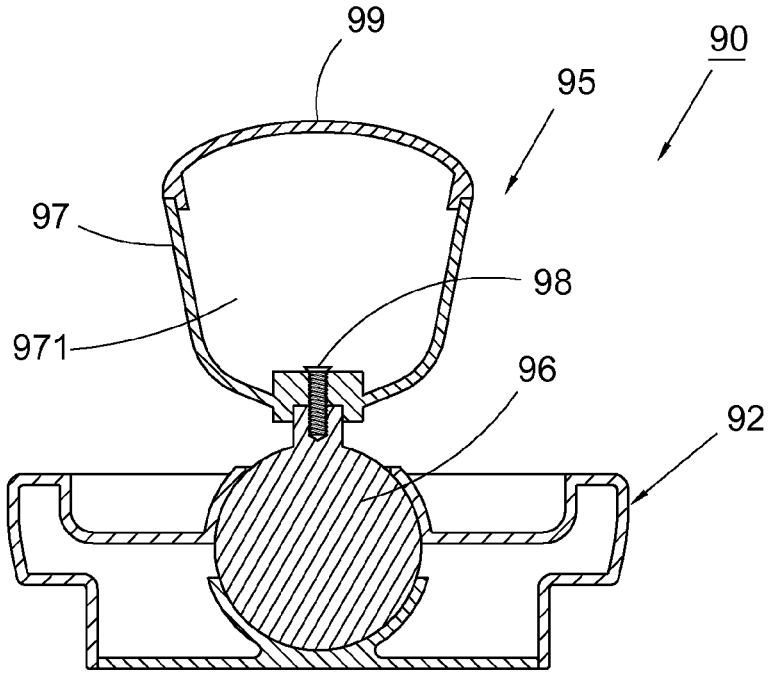
FIG. 12 is a sectional assembled view of an embodiment of the present invention.
Figure 13:
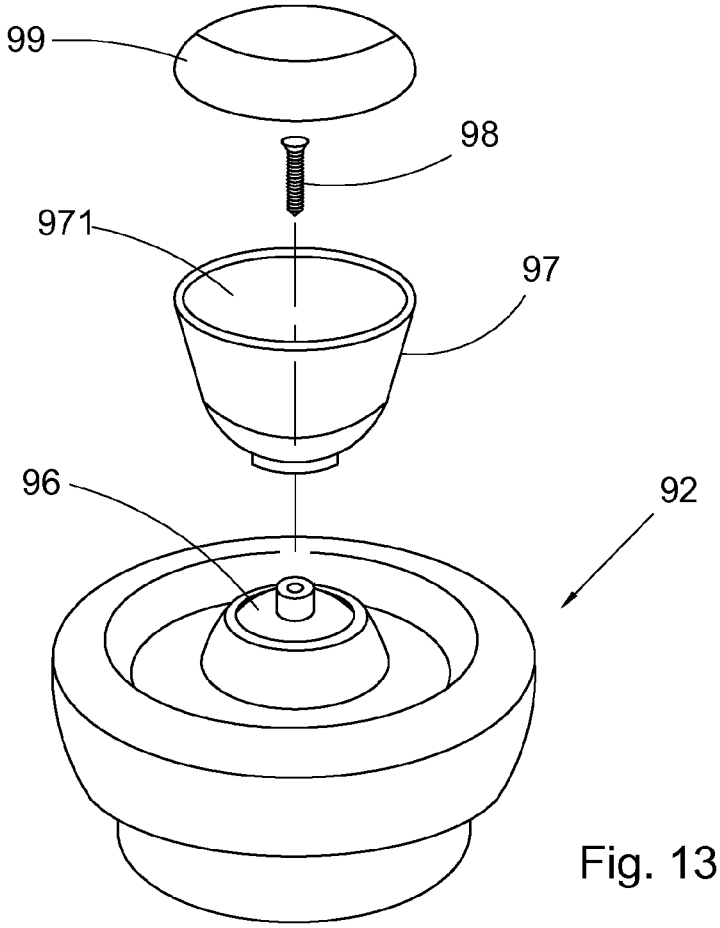
FIG. 13 is a perspective exploded view of FIG. 12.

FIGS. 12 and 13 show another embodiment of the pusher 90 of the present invention, in which the main body 92 can be any of the aforesaid structures. The pushing knob 95 includes a rotary member 96, a knob member 97 and a connecting member 98. The connecting member 98 is a screw member which is screwed into the knob member 97 and the rotary member 96 from upper side to lower side so as to fixedly connect the knob member with the rotary member. In addition, the top face of the knob member 97 is formed with a cave 971 in which the connecting member 98 is hidden in the knob member. A cover body 99 covers a top opening of the knob member.

Figure 14:
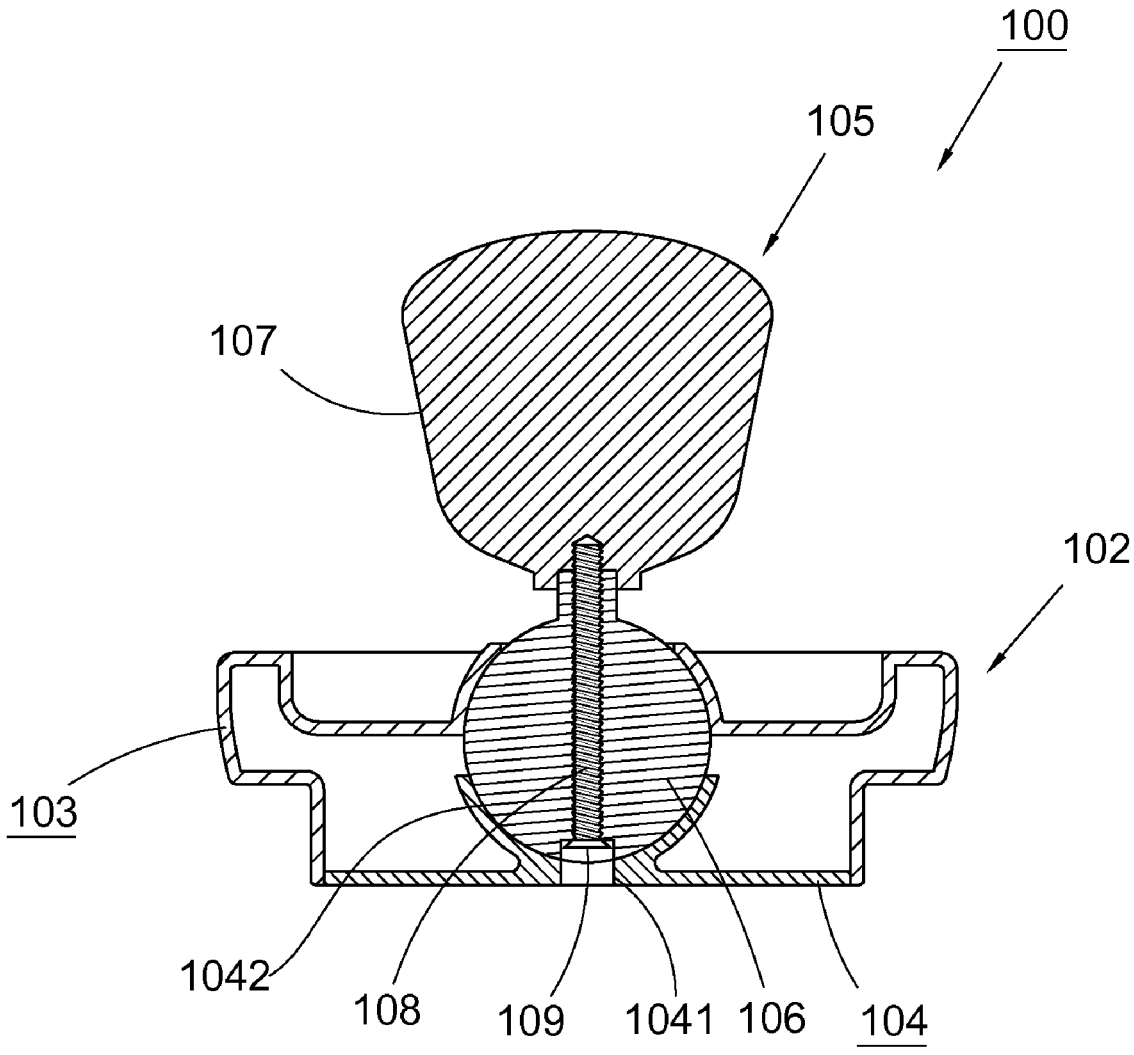
FIG. 14 is a sectional assembled view of an embodiment of the present invention.
Figure 15:
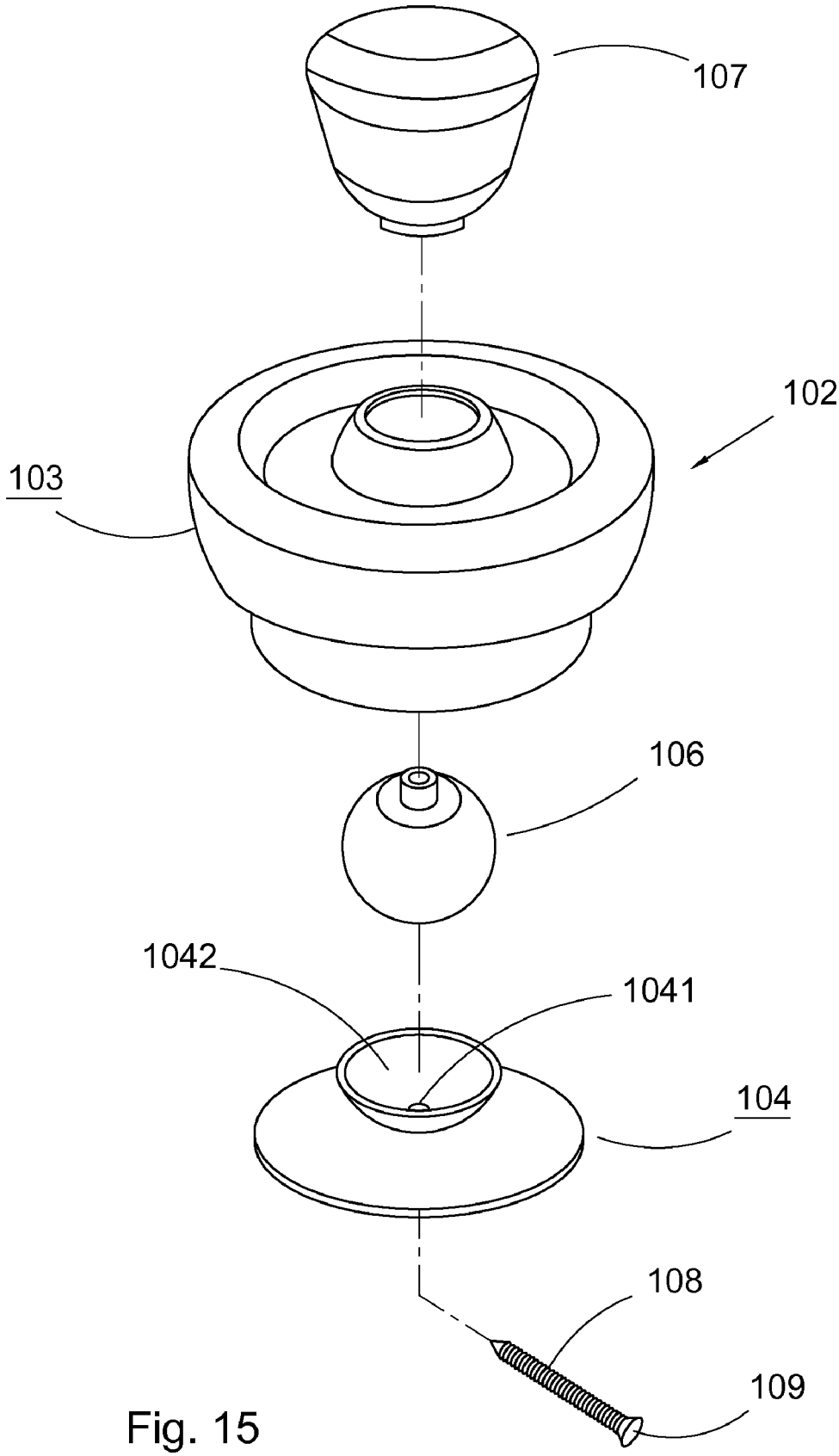
FIG. 15 is a perspective exploded view of FIG. 14.

FIGS. 14 and 15 show another embodiment of the pusher 100 of the present invention, in which pushing knob 105 includes a rotary member 106, a knob member 107 and a connecting member 108. The connecting member 108 is a screw member which is screwed into the rotary member 106 and the knob member 107 from lower side to upper side so as to fixedly connect the knob member with the rotary member. The head section of the connecting member 108 sinks into the rotary member 106. In addition, the bottom face of the lower half body 104 of the main body 102 is formed with a through hole 1041 communicating with the lower cavity 1042. After the upper half body 103 is assembled with the lower half body 104, the connecting member 108 is passed through the through hole 1041 and screwed into the rotary member and the knob member.

When using the pusher of the present invention, the pushing knob is angularly displaceable within the main body in the direction of the pushing force. Therefore, the player's wrist can be freely twisted. This inventions meets the considerations of human body engineering so that the player's wrist will not easily feel stiffness and be hurt. In addition, it is easier and more comfortable for a player to hold the pushing knob.

The above embodiments are only used to illustrate the present invention, not intended to limit the scope thereof. Many modifications of the above embodiments can be made without departing from the spirit of the present invention.

What is claimed is:

1. A pusher of a hockey game table, comprises: A pusher of a hockey game table, comprises:

a main body having an internal spherical space, a top face of the main body being formed with an opening communicating with the space;

a pushing knob including a spherical rotary member and a rod member, the rotary member being rotatably disposed in the spherical space of the main body, a top section of the rotary member being positioned in the opening of the main body; the rod member being positioned outside the main body, and a bottom end of the rod member being connected with the top section of the rotary member; and the main body is composed of an upper half body and a lower half body, an interior of the upper half body being formed with a semispherical upper cavity, the upper cavity having an opening facing downward, the inner diameter of the upper cavity being upward tapered; an interior of the lower half body being formed with a semispherical lower cavity, the lower cavity having an opening facing upward, the inner diameter of the lower cavity being downward tapered; the lower half body being combined with the upper half body with the upper and lower cavities aligned with each other to together form the spherical space, the opening being formed on the top face of the upper half body to communicate with the upper cavity.

2. The pusher as claimed in claim 1, wherein the pushing knob further includes a knob member connected with a top end of the rod member.

3. The pusher as claimed in claim 2, wherein the rod member is a threaded rod, two ends of the rod member being respectively connected with the rotary member and the knob member.

4. The pusher as claimed in claim 2, wherein the bottom end of the rod member is fixedly connected with the rotary member, the top end of the rod member being formed with a split and being resilient, the top end of the rod member being also formed with a hook head; a connecting hole being formed on the bottom face of the knob member, a wall of the connecting hole being formed with a shoulder section; the top end of the rod member being fitted into the connecting hole of the knob member with the hook head hooking the shoulder section of the connecting hole so as to connect the rod member with the knob member.

5. The pusher as claimed in claim 2, wherein the top end of the rod member is fixedly connected with the knob member, the bottom end of the rod member being formed with a split and being resilient, the bottom end of the rod member being also formed with a hook head; a connecting hole being formed on the top face of the rotary member, a wall of the connecting hole being formed with a shoulder section; the bottom end of the rod member being fitted into the connecting hole of the rotary member with the hook head hooking the shoulder section of the connecting hole so as to connect the rod member with the knob member.

6. The pusher as claimed in claim 2, wherein an opening is formed on a bottom face of the upper half body; the lower half body is fitted in the opening.

7. The pusher as claimed in claim 1, wherein the top face of the main body is recessed to form an annular depression centered at the opening.

8. The pusher as claimed in claim 1, wherein an outer circumference of the main body is stepped to form a lower half small diameter section and an upper half large diameter section.

9. The pusher as claimed in claim 1, wherein an opening is formed on a bottom face of the upper half body; the lower half body is fitted in the opening.

10. A pusher of a hockey game table, comprises:

a main body having an internal spherical space, a top face of the main body being formed with an opening communicating with the space;

a pushing knob including a spherical rotary member and a knob member, the rotary member being rotatably disposed in the spherical space of the main body, a top section of the rotary member being positioned in the opening of the main body, a bottom end of the knob member being connected with the top section of the rotary member, the knob member being positioned outside the main body, and the main body is composed of an upper half body and a lower half body, an interior of the upper half body being formed with a semispherical upper cavity, the upper cavity having an opening facing downward, the inner diameter of the upper cavity being upward tapered; an interior of the lower half body being formed with a semispherical lower cavity, the lower cavity having an opening facing upward, the inner diameter of the lower cavity being downward tapered; the lower half body being combined with the upper half body with the upper and lower cavities aligned with each other to together form the spherical space, the opening being formed on the top face of the upper half body to communicate with the upper cavity.

11. The pusher as claimed in claim 10, wherein the pushing knob further includes a connecting member, two ends of the connecting member being respectively fixedly connected with the rotary member and the knob member.

12. The pusher as claimed in claim 11, wherein the connecting member is a screw member screwed into the rotary member and the knob member to fixedly connect the knob member with the rotary member.

13. The pusher as claimed in claim 12, wherein the top face of the knob member is formed with a cave in which the connecting member is hidden, the pushing knob further including a cover body covering a top opening of the knob member.

14. The pusher as claimed in claim 12, wherein the bottom face of the main body is formed with a through hole communicating with the spherical space.

15. The pusher as claimed in claim 11, wherein an opening is formed on a bottom face of the upper half body; the lower half body is fitted in the opening.

16. The pusher as claimed in claim 10, wherein the top face of the main body is recessed to form an annular depression centered at the opening.

17. The pusher as claimed in claim 10, wherein an outer circumference of the main body is stepped to form a lower half small diameter section and an upper half large diameter section.

18. The pusher as claimed in claim 10, wherein an opening is formed on a bottom face of the upper half body; the lower half body is fitted in the opening.

* * * * *